US005717158A

United States Patent [19]

Capellos et al.

[11] Patent Number: 5,717,158

[45] Date of Patent: Feb. 10, 1998

[54] HIGH ENERGY MELT CAST EXPLOSIVES

[75] Inventors: Christos Capellos, Morris Plains; Brian E. Travers, Wayne, both of N.J.

[73] Assignee: The United States of America as represented by the Secretary of the Army, Washington, D.C.

[21] Appl. No.: 743,808

[22] Filed: Nov. 5, 1996

[51] Int. Cl.[6] ..... C06B 45/10

[52] U.S. Cl. ..... 149/19.4; 149/19.5; 149/19.6; 149/19.7; 149/18; 149/92

[58] Field of Search ..... 149/18, 92, 19.4, 149/19.5, 19.6, 19.7

[56] References Cited

U.S. PATENT DOCUMENTS

| | | | |
|---|---|---|---|
| 4,325,759 | 4/1982 | Voigt et al. | 149/19.92 |
| 4,841,865 | 6/1989 | Liberman | 149/109.6 |
| 5,529,649 | 6/1996 | Lund et al. | 149/19.4 |
| 5,567,906 | 10/1996 | Reese et al. | 102/307 |
| 5,587,553 | 12/1996 | Braithwaite et al. | 149/19.6 |

*Primary Examiner*—Edward A. Miller

*Attorney, Agent, or Firm*—John F. Moran; John E. Callaghan

[57] ABSTRACT

A high energy propellant comprising 1,3,3-Trinitroazetidine or TNAZ, admixed with up to about five percent of cellulose acetate butyrate or CAB by adding the CAB at a temperature slightly above the melting point of the TNAZ. A preferred amount of CAB is from about one percent to about three percent by weight of CAB, based on the weight of TNAZ. When the mixture is melt cast, the crystal structure is finer or smaller than that of pure explosive, producing increased mechanical strength and better resistance to impact. Inclusion of a thermoplastic binder is also contemplated to improve the mechanical integrity of the explosive. Preferred binders are BAMO/AMMO, HYTREL and ESTANE. The formulation permitted inclusion of small quantities of other high explosives because a uniform dispersion was obtained. Preferred high explosive are S-TNT, S-TNB, RDX, HMX and mixtures thereof.

15 Claims, No Drawings

HIGH ENERGY MELT CAST EXPLOSIVES

The invention described herein may be manufactured, used, and licensed by or for the U.S. Government for U.S. Governmental purposes.

FIELD OF THE INVENTION

The present invention relates generally to a high energy propellant composition. More particularly the invention relates to a propellant that includes a high energy explosive in combination with small quantities of cellulose acetate butyrate as an improved binder.

BACKGROUND OF THE INVENTION

As with the evolution of many technologies, new weapon systems require higher munitions performance. Current standard propellants do not have adequate energy to deliver the performance required for systems that are presently being developed. JA2, which is a standard double base propellant used, for example, in the M829A1 and M829A2 tanks rounds, has an impetus value of 1150 Joules/gram or J/g. M43, which is used in the M900A1 cartridge, has an impetus of 1181 J/g. Both of these conventional propellants do not have the energy level to deliver the muzzle velocity required in future high energy tank systems such as the M829E3.

The next generation military explosive, 1,3,3-Trinitroazetidine or TNAZ, is somewhat brittle when formulated into pressed billets of pure TNAZ. In addition, mechanical strength of the explosive is not as high as would be desirable, particularly when the material is being extruded into cartridge formulations. It would be a great advance in the art if improved formulations using TNAZ were to be discovered. It is particularly important to improve the amount of acceleration required to fracture cast TNAZ if it is to take its place as a desirable explosive.

In addition, even TNAZ is not as high in energy content as combination formulations. However, it has not been possible to formulate explosives with small quantities of other explosives such as 2,4,6-trinitrotoluene or S-TNT and 1,3,5-trinitrobenzene or S-TNB, RDX and HMX into TNAZ and achieve adequate dispersion of the minor quantity within the larger explosive. A way of properly dispersing these materials is needed.

In addition the foregoing, it would be a great advance in the explosive art if a formulation could be prepared that would permit casting of TNAZ that is significantly less sensitive to impact.

Finally, it has been known that explosives are optimized when they are press loaded to a theoretical maximum density or TMD, even though the formulations do not always require 100% of TMD.

Accordingly, one object of the present invention is to provide a formulation of TNAZ that has improved mechanical strength.

Another object of this invention is to provide a formulation for TNAZ that permits incorporation of minor amounts of other explosives such that the minor amounts are uniformly distributed throughout the formulation.

An additional object of this invention is to provide a formulation of TNAZ that is less sensitive to impact and yet which is capable of achieving its theoretical maximum density.

Other objects will appear hereinafter.

SUMMARY OF THE INVENTION

It has now been discovered that the above and other objects of the present invention may be accomplished in the following manner. Specifically a high energy explosive has been discovered that, in its simplest form, comprises 1,3,3-trinitroazetidine admixed with up to about five percent of cellulose acetate butyrate. A preferred range of cellulose acetate butyrate is from about one percent to about three percent by weight of the total explosive.

The preferred method of forming the high energy explosive of this invention is to add the cellulose acetate butyrate at a temperature less than about 10°–20° C. above the melting point, of the 1,3,3-trinitroazetidine. When formed by this melt addition process, the explosive of the present invention produces a crystal structure of the explosive that is finer than that of pure 1,3,3-trinitroazetidine.

It is also contemplated that the explosive include a small quantity of a second high explosive. Preferred second high explosives are selected from S-TNT, S-TNB, RDX, HMX and mixtures thereof.

It is also contemplated that the explosive include a small quantity of a thermoplastic binder, preferably in an amount ranging from about two percent to about ten percent of the binder. The preferred binder is selected from the group consisting of BAMO/AMMO, HYTREL and ESTANE. Of these, BAMO/AMMO is most preferred. BAMO/AMMO is an oxetane thermoplastic elastomer energetic binder. It too may be melted at moderate elevated temperature and then solidified into an elastomeric material once it is cooled to a lower temperature such as ambient or lower. It is made from two types of monomers: 3,3-bis-azidomethyl-oxetane, or BAMO as a hard block, and 3-azidomethyl-3-methyloxetane, or AMMO as a soft block.

DETAILED DESCRIPTION OF THE PREFERRED EMBODIMENT

The present invention has many advantages over the prior art explosive formulations. In its simplest form, the invention comprises a high energy explosive such as 1,3,3-trinitroazetidine admixed with up to about five percent of cellulose acetate butyrate. A preferred range of cellulose acetate butyrate is from about one percent to about three percent by weight of the total explosive. Other explosives and a binder may also be added to the formulation.

The method of making the high explosive of the present invention permits incorporation of binder materials such as polymers and elastomers into high explosive materials. The method is applicable to all high explosive materials that are stable at temperatures slightly above their melting points. The method comprises the steps of melting the explosive at a temperature slightly above its particular melting point, normally about 10°–20° C. above the melting temperature. Powdered cellulose acetate butyrate or CAB in powered form is added to the molten explosive and the mixture is stirred. Upon stirring, it has been found that the powdered CAB becomes completely dissolved and/or plasticized by the liquid explosive. Upon cooling, the structure was examined. In each case, the crystal structure of the solidified explosive samples that included CAB had a finer or smaller crystal structure than that of the pure TNAZ. For that reason, it is believed, the mechanical strength of the explosive/binder mixture is higher than that of the pure high explosive.

In one experiment, mechanical strength was measured by comparing a formulation comprising TNAZ/CAB formulation with a weight percent of 97% and 3%, respectively, to a pure cast TNAZ formulation. The results are presented below in Table I. As can be easily seen, the mechanical strength of the explosive of this invention is more than twice as strong when subjected to high acceleration.

TABLE I

| Mechanical Strength Test | | | |
|---|---|---|---|
| Sample | TNAZ, % | CAB, % | fracture acceleration, g's |
| A | 100 | 0 | 35,000 |
| B | 97 | 3 | 75,000 |

A number of other high explosives have been incorporated into the present invention as second explosive. Preferred second high explosives are selected from S-TNT, S-TNB, RDX, HMX and mixtures thereof. The method of this invention includes the step of gradually introducing other such energetic materials at a temperature of about 115° C. provides for very uniformly distributed second explosives in the TNAZ/CAB matrix that is formed during the melt mixing step. To demonstrate this step, an experiment was performed in which 60% by weight of the explosive HMX was added to a melted combination of TNAZ and CAB in a 97%/3% weight ration. The admixture was easily made and the distribution was complete and uniform throughout.

It is also contemplated that the explosive include a small quantity of a thermoplastic binder, preferably in an amount ranging from about two percent to about ten percent of the binder.

BAMO/AMMO, the most preferred binder because it is also energetic, is an oxetane thermoplastic elastomer energetic binder. It too may be melted at moderate elevated temperature and then solidified into an elastomeric material once it is cooled to a lower temperature such as ambient or lower. It is made from two types of monomers: 3,3-bis-azidomethyl-oxetane, or BAMO as a hard block, and 3-azidomethyl-3-methyloxetane, or AMMO as a soft block. The oxetane thermoplastic elastomer energetic binder is available from Thiokol Corporation. It is capable of being melted at elevated temperatures to allow the binder to be processable with other propellant ingredients without the use of solvents, and this is a major advantage.

Other binders that have been used are HYTREL and ESTANE polymers.

One property that the present invention possesses is an improved sensitivity to impact. A series of samples were prepared according to the method of this invention, and those samples are presented below in Table II. The melt cast samples were ground with a Wiley mill to pass through a USS# 20 mesh screen. Also shown in Table II below is the impact value in centimeters, with a plus/minus variation for each sample. In come examples a binder has also been added.

TABLE II

| Sample | TNAZ, % | CAB, % | Binder, % | Impact, cm. |
|---|---|---|---|---|
| A | 100[a] | 0 | 0 | 21.58 +/− 1.06 |
| B | 100 | 0 | 0 | 22.55 +/− 1.04 |
| C | 97 | 3 | 0 | 29.40 +/− 1.80 |
| D | 98 | 2 | 0 | 24.65 +/− 0.65 |
| E | 99 | 1 | 0 | 24.89 +/− 0.55 |
| F | 99.5 | 0.5 | 0 | 26.56 +/− 0.34 |
| G | 90 | 2 | 8[b] | 42.10 +/− 1.50 |
| H | 95 | 1 | 4[b] | 38.50 +/− 1.70 |
| I | 90 | 2 | 8[c] | 43.20 +/− 1.50 |
| J | 95 | 1 | 4[c] | 37.70 +/− 1.80 |
| K | 96 | 0 | 4[c] | 29.41 +/− 0.35 |
| L | 90 | 2 | 8[d] | 48.50 +/− 1.40 |
| M | 95 | 1 | 4[d] | 38.50 +/− 0.70 |
| N | 96 | 0 | 4[d] | 26.26 +/− 1.83 |

[a]dried powder TNAZ, whereas the other data is from TNAZ or mixture that have been cast and ground.
[b]BAMO/AMMO binder
[c]HYTREL binder
[d]ESTANE binder As can be seen, the present invention provides substantial improvement in impact values, showing that they are substantially less sensitive to impact when compared to a baseline of pure cast TNAZ.

In addition to the increased strength of mechanical properties and decrease in impact sensitivity, the TNAZ formulations also exhibit another desirable property that further substantiates the importance of the present invention. This property permits the formulations to be either cast loaded or press loaded into munitions, and this is important because there are a variety of munitions that will be improved by the explosives of this invention. A pressure density study was conducted on three TNAZ/CAB formulations using a ⅜ inch diameter die set. Since it has been known that TNAZ may be press loaded to its theoretical maximum density, pure TNAZ was used as a control during this study. The results are presented below in Table III, and these results clearly show that all of the TNAZ/CAB formulations pressed to a higher percent of theoretical maximum density in the ⅜ inch tooling for these examples. From this it is extrapolated that the TNAZ/CAB formulations ultimately selected for use in explosives and the like will achieve their maximum TMD when they are press loaded under optimum conditions.

TABLE III

| Sample Pressure | | Percent TMD Achieved at | | |
|---|---|---|---|---|
| TNAZ/CAB | Press temp., °C. | 25 ksi | 28 ksi | 30 ksi |
| 98:2 | 160 | 95.00 | 96.31 | 96.48 |
| 98:2 | 120 | 94.61 | 95.71 | 96.31 |
| 99:1 | 160 | 96.17 | 96.17 | 96.17 |
| 99:1 | 120 | 94.31 | 94.97 | 95.08 |
| 99/0/5 | 169 | 95.09 | 95.09 | 95.91 |
| 99/0/5 | 120 | 94.60 | 95.04 | 94.93 |
| TNAZ | 160 | 92.23 | 94.40 | 95.05 |
| TNAZ | 120 | 91.30 | 95.59 | 95.16 |

In almost every case, the explosive formulation of the present invention has a pressure density as high or higher than pure TNAZ.. This supports the finding that course material seems to press to a higher percent of TMD than fine material.

While particular embodiments of the present invention have been illustrated and described herein, it is not intended that these illustrations and descriptions limit the invention. Changes and modifications may be made herein without departing from the scope and spirit of the following claims.

We claim:

1. A high energy explosive, comprising:

1,3,3-trinitroazetidine admixed with up to about five percent of cellulose acetate butyrate.

2. The explosive of claim 1, wherein said cellulose acetate butyrate comprises from about one percent to about three percent by weight of the explosive.

3. The explosive of claim 1, wherein said high energy explosive is formed by adding said cellulose acetate butyrate at a temperature less than about 20° C. above the melting point of said 1,3,3 -trinitroazetidine.

4. The explosive of claim 1, wherein the crystal structure of said explosive is finer than that of pure 1,3,3-trinitroazetidine.

5. The explosive of claim 1 which further includes a small quantity of a second high explosives.

6. The explosive of claim 5 wherein said second high explosive is selected from the group consisting of S-TNT, S-TNB, RDX, HMX and mixtures thereof.

7. The explosive of claim 1 which further includes a small quantity of a thermoplastic binder.

8. The explosive of claim 7, wherein said binder is selected from the group consisting of BAMO/AMMO, HYTREL and ESTANE.

9. The explosive of claim 8, which includes about two percent to about ten percent of said binder.

10. A high energy explosive, comprising:

1,3,3-trinitroazetidine admixed with from about one percent to about three percent of cellulose acetate butyrate and from about two percent to about ten percent of a thermoplastic binder.

11. The explosive of claim 10 in which each explosive further includes an explosive plasticizer.

12. The explosive of claim 11, wherein said high energy explosive is formed by adding said cellulose acetate butyrate at a temperature less than about 20° C. above the melting point of said 1,3,3-trinitroazetidine and the crystal structure of said explosive is finer than that of pure 1,3,3-trinitroazetidine.

13. The explosive of claim 11 which further includes a small quantity of a second high explosive.

14. The explosive of claim 13 wherein said second high explosive is selected from the group consisting of S-TNT, S-TNB, RDX, HMX and mixtures thereof.

15. The explosive of claim 10, wherein said binder is selected from the group consisting of BAMO/AMMO, HYTREL and ESTANE.

* * * * *